United States Patent [19]

Yokota et al.

[11] Patent Number: 4,669,896

[45] Date of Patent: Jun. 2, 1987

[54] ACTUATING MECHANISM FOR PRINTING HEAD OF PRINTING MACHINE

[75] Inventors: Yuuji Yokota; Kazuhiro Karuishi, both of Iwate, Japan

[73] Assignee: Kabushiki Kaisha Sato, Japan

[21] Appl. No.: 707,873

[22] Filed: Mar. 4, 1985

[30] Foreign Application Priority Data

Mar. 27, 1984 [JP] Japan ..... 59-57208

[51] Int. Cl.[4] ..... B41J 3/20

[52] U.S. Cl. ..... 400/120; 400/648

[58] Field of Search ..... 400/120, 59, 648; 346/76 PH

[56] References Cited

U.S. PATENT DOCUMENTS 4,421,428 12/1983 Noda et al. ..... 400/512 X

FOREIGN PATENT DOCUMENTS 64042 6/1978 Japan ..... 400/120
62183 5/1981 Japan ..... 400/120
126180 7/1983 Japan ..... 400/59

OTHER PUBLICATIONS

Perry, "Thermal Print Head Control", *IBM Technical Disclosure Bulletin*, vol. 21, No. 4, Sep. 1978, pp. 1594–1595.

*Primary Examiner*—Clifford D. Crowder

*Attorney, Agent, or Firm*—Ostrolenk, Faber, Gerb & Soffen

[57] ABSTRACT

An actuating mechanism for a printing head of a printing machine in which a printing head is movable to be pressed against a platen roller and an information recording medium is passed between the platen roller and the printing head. The printing head is swingable around a pivot. A set spring is interlocked with the printing head to move the same toward the platen. The set spring is also connected with an actuating lever that is pivotable between first and second detented positions. To avoid the strong banging of the printing head against the platen roller during setting in of the information medium, also connected with the actuating lever is a suppressing member link which holds the printing head off the platen roller and against the force of the set spring when the actuating lever, also connected with the suppressing member link, is pivoted to move the suppressing member link to raise the printing head. Upon movement of the actuating lever to its other detented position, the suppressing member link is raised, which permits the printing head to move toward the platen roller. In an alternate embodiment, the suppressing member link is replaced with a tension spring which also acts to prevent the printing head from moving to bump against the platen roller when the actuating lever is moved to the position at which it should cause the printing head to lift off the platen roller.

7 Claims, 2 Drawing Figures

ACTUATING MECHANISM FOR PRINTING HEAD OF PRINTING MACHINE

BACKGROUND OF THE INVENTION

1. Field of the Invention

This invention relates to an actuating mechanism for use in a printing head of a printing machine, and more particular for use in a printing machine of the type in which a platen roller and a printing head are pressed against each other and in which either the platen roller or the printing head is swingably moved while the other one is fixed. The actuating mechanism of the present invention is especially suitable for a thermal transfer printer which prints labels or tags on a tape-like web using a carbon ribbon.

2. Description of the Prior Art

In conventional printing machines, the printing mode is set by moving or turning either a printing head or a platen roller. In a printing machine of the type in which the printing head is turned in order to press the printing head to the platen roller, a set spring is stretched betwen the printing head and an actuating means that comprises an actuating lever and engaging members. The tension of the set spring is exerted on the platen roller by means of the actuating device. An information recording medium, which is disposed under pressure between the platen roller and the printing head, is printed. The printing head that is released from the engaging means in the actuating device is caused to bump abrubtly against the platen roller by the tension of the spring. In this action, the printing head is liable to be damaged.

SUMMARY OF THE INVENTION

In view of the foregoing, it is a principal object of the present invention to provide an improved actuating mechanism for a printing head of a printing machine, which is free from the above-described disadvantage.

Another object of the present invention is to provide an actuating mechanism for a printing head of a printing machine, which suppresses the abruptly exerted tension of the set spring for moving the printing head toward the platen roller, so that the printing head is stopped just before it bumps against the platen roller, thereby avoiding damage to the printing head caused by such bumping.

A further object of the present invention is to provide an actuating mechanism for a printing head of a printing machine, which mechanism is simple and compact in structure, easy to manufacture, and smooth and durable in operation.

In the present invention, in the actuating mechanism for the printing head of a printing machine, either the platen roller or the printing head is swingably movable. The swingable element is provided with a set spring which is interlocked with an an actuating device and also with a suppressing member which suppresses the tension of the set spring, thereby avoiding the bumping that is caused in the setting of the platen roller and the printing head.

Other objects and features of the invention will be apparent from the following description considered with the accompanying drawings.

DESCRIPTION OF THE PREFERRED EMBODIMENT

Figure 1:
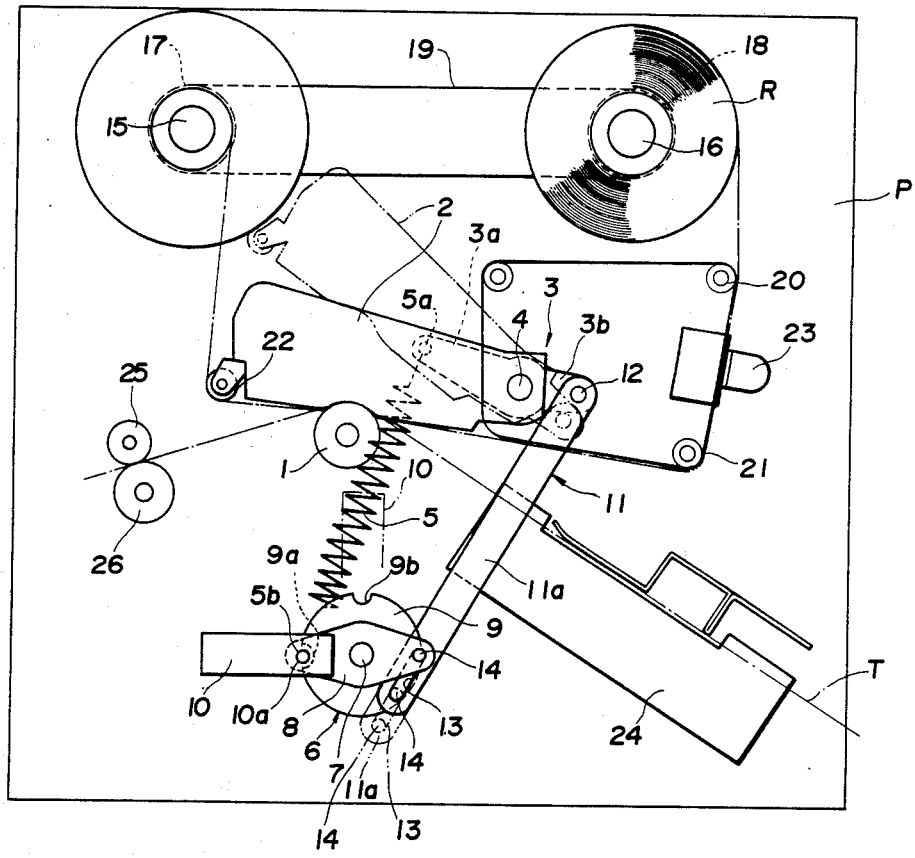
FIG. 1 is a schematic front view of an embodiment of the actuating mechanism for a printing head according to the present invention in which a supressing member link member is provided for a set spring of the printing head.

A first embodiment of the actuating mechanism according to the present invention is shown in FIG. 1.

In the printing section of a thermal printer P, a platen roller 1 and a printing head 2 are disposed in opposed relationship. The platen roller 1 is positioned stationary in the printer, and the printing head 2 is pivotally secured to a pivot shaft 4 as a fulcrum. The invention also can be used where the printing head is the stationary element and the platen is the element that moves and swings. The printing head 2, in its solid line set (closed) position, presses an overlaid carbon ribbon R and a tape-like web T of labels together and they are pressed against the surface of the platen roller 1. Printing is carried out on the label web in this position. Before printing, the printing head is in a release position which is indicated by two-dot chain lines.

Between the printing head 2 and a below-described actuating device 6 are disposed a set spring 5 and a suppressing member 11 for suppressing the action of the spring 5.

One end 5*a* of the set spring 5 is attached to an inner support 3*a* which is attached to the pivot shaft 4 of the printing head 2. The inner support 3*a* pivots together with the printing head 2 and the shaft 4. The other end 5*b* of the spring 5 is attached to a swingable supporting member 8 which can turn on a pivot shaft 7 between the horizontal orientation of the member 8 which is shown in solid lines in FIG. 1 and which tensions the spring 5, and a vertical orientation which relaxes the spring 5. One end of this swingable supporting member 8 is provided with an actuating lever 10. That lever is movable by the user's finger between the solid line horizontal and broken line vertical orientation. The engaging projection 10*a* of the lever 10 is caught into or released from one of the lateral engaging recess 9*a* and the top recess 9*b* of a stationary non-rotating supporting member 9. The lever 10 is acted upon under the force of spring 5.

The suppressing member 11 comprises an elongate link member 11*a*. One end of the link member 11*a* is pivoted to an outer support 3*b* of the pivot shaft 4 of the printing head 2 by means of a pivot pin 12. The outer support 3*b* is integrated with the inner support 3*a* and the printing head 2. The other end of the link member 11*a* is provided with a slot 13 which is in engagement with a support pin 14 that is formed on the swingable supporting member 8 of the actuating device 6.

The carbon ribbon R and the tape-like web T of the labels or tags are overlaid in layers and are passed through the space between the platen roller 1 and the printing head 2. Their passage is now described.

The carbon ribbon is initially wound as a roll on a feeding shaft 16. The ribbon R is wound up by a winding shaft 15, which is driven by a stepping motor, or the like. The carbon ribbon R, which is guided by guide rollers 20 and 21, gives the desired print to the tapelike web T in the space between the printing head 2 and the platen roller 1. After printing, that used carbon ribbon is wound up by the winding shaft 15 after the ribbon has passed the other guide roller 22.

The transmitting means 19 is wrapped around the pulleys 17 and 18 that are fixed to the winding shaft 15 and the feeding shaft 18. This transmitting means 19 produces a rotary force that is the reverse of the feeding direction of the carbon ribbon R, whereby the transmitting means 19 eliminates the slackening or meandering caused by excess feeding of the carbon ribbon R. A sensor 23 monitors motion of the ribbon R.

Meanwhile, the separate tape-like web T of labels or tags is rolled from a feeding reel, or the like (not shown), and it is passed through the printing section between the printing head 2 and the platen roller 1 by way of a nipping holder 24. After printing, the tapelike web T is then guided by a pair of guide rollers 25 and 26 and is moved to a cutting device (not shown) at which it is cut into predetermined lengths.

The operation of this first embodiment is now described.

In the opened state of the printing head 2 shown by the two-dot chain lines in FIG. 1, the actuating lever 10 of the actuating device 6 is set in the broken line, upstanding condition perpendicular to the stationary supporting member 9, through the engaging members of an engaging projection 10*a* being received in the engaging recess 9*b*.

During this opened state of the printing head 2, the set spring 5 normally pulls the printing head 2 toward the platen roller 1. However, the movement of the actuating lever 10 has rotated the swingable member 8 clockwise. The link member 11*a* is shifted to a position in which the force of the set spring 5 is stopped, because the support pin 14 (one-dot chain line) is held in the lowermost end of the slot 13. This pushes the link member 11*a* down to its broken line position. Through connection of the link member to the outer support 3*b* and thereby to the printing head 2, the printing head is held in the opened state.

The carbon ribbon R and the tape-like web T are set into the mechanism during this opened state of the printing head 2. After that, the vertical actuating lever 10 of the actuating device 6 is released from recess 9*b*. The printing head 2 is pulled and is quickly turned toward the platen roller 1 by the set spring 5. The interlocked actuating lever 10 is turned counterclockwise by the rotation of the printing head. The link member 11*a* is shifted to the position that is indicated by solid lines by the printing head and by the pin 14 in the slot 13. More particularly, the support pin 14 (solid line) is held at the lowermost position in the slot 13 and through the connection of the link 11*a* with the printing head, this absorbs the tension of the set spring 5. In other words, the printing head 2 is abruptly stopped just before it comes into contact with the platen roller 1.

The setting of the tensile force of this set spring 5 and the length of the link member 11*a* are important, and these values can be determined by experiment.

When the aforesaid setting has been done properly, a small clearance is left between the printing head 2 and the platen roller 1, as shown by the solid lines in the drawing. The actuating lever 10 is then held completely horizontally and the engaging projection 10*a* of the lever is caught in the engaging recess 9*a* of the stationary supporting member 9.

Figure 2:
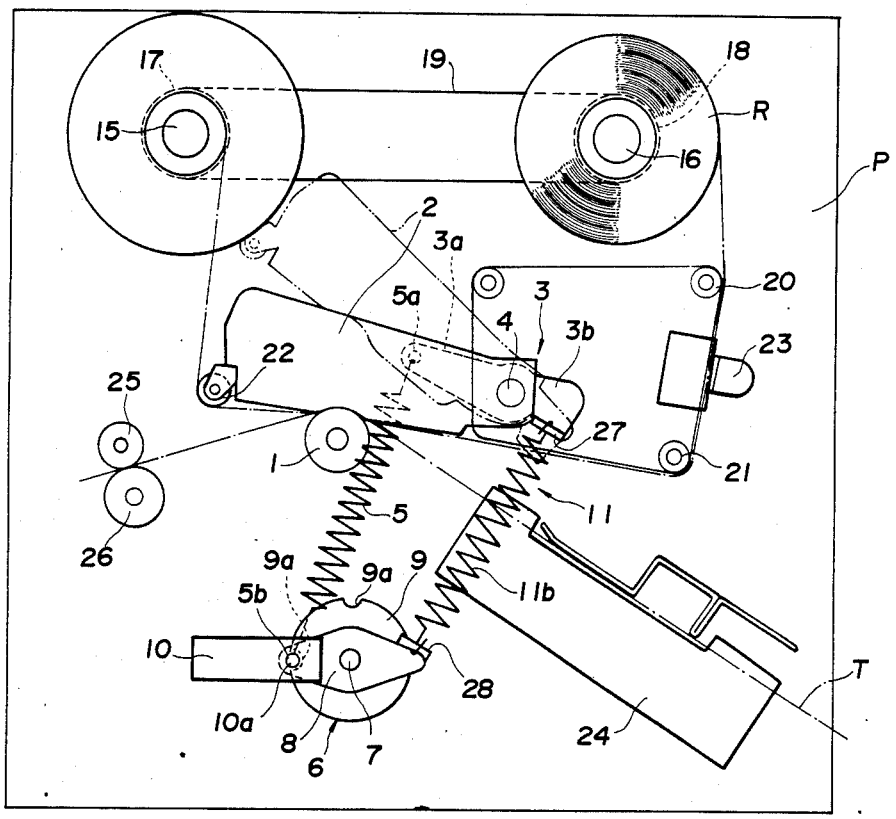
FIG. 2 is a schematic front view of another embodiment of the actuating mechanism in which suppressing member in the form of a spring is provided for the set spring of the printing head.

In the second embodiment of the present invention shown in FIG. 2, only the suppressing member 11 for a set spring 5 is different, and all other parts are almost the same as those in the first embodiment. The same parts are indicated by the same reference numerals without further detailed description.

In like manner as the first embodiment, one end 5*a* of a set spring 5 is attached to an inner support 3*a* of the pivot shaft 4 of the printing head 2. The other end 5*b* is attached to a swingable supporting member 8 that is pivotally secured to a pivot shaft 7.

The suppressing member 11 in this embodiment is comprised of a spring 11*b* which absorbs the tension of the set spring 5. The spring 11*b* is also a tension spring like the set spring 5. The position of the spring 11*b* is on the side opposite to the set spring 5 with regard to the pivot shaft 4 of the printing head 2.

One end of the spring 11*b* is attached to a fixing member 27 on the outer support 3*b* of the pivot shaft 4. The other end of the spring 11*b* is attached to a fixing member 28 that is formed on the swingable supporting member 8.

With the above mechanism, the abrupt tension of the set spring 5 toward the platen roller 1 caused in the setting (release of engagement) of the printing head 2, is eliminated by the tension of the spring 11*b* in the opposite direction.

In the present invention, either the platen roller or the opposed printing head is made swingable, and the swingable device is provided with a set spring which is interlocked with an actuating device. A suppressing member, such as a link member or such as another spring which is set to the opposite side relative to the pivot shaft of the printing head instantly absorbs or stops the tension of the set spring. Therefore, the tensile energy of the set spring can be suppressed to avoid the bumping of the printing head and the platen roller against each other. Accordingly, the printing head can be prevented from damage caused by the bumping.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. Actuating means for a printing head of a printing machine, wherein the printing machine comprises a platen roller and a printing head which is opposed to the platen roller, the printing head and platen roller being adapted to be pressed against each other; and means for passing an information recording medium between the platen roller and the printing head for being imprinted upon by the printing head pressing against the platen roller;

a support for the platen roller and the printing head; one of the platen roller and the printing head being swingably supported on the support for movement toward the other; the actuating means being for the one of the printing head and the platen roller which is swingably movable toward the other;

the actuating means comprising:

a set spring which is interlocked with the movable one of the printing head and platen roller and an actuating member to which the set spring is also connected; the actuating member supporting the set spring to pull the movable one of the printing head and the platen roller toward the other;

suppressing means comprising a link also connected with the movable one of the printing head and the platen roller for preventing the movable one from moving toward the other under the action of the set spring; the suppressing means being connected with the actuating member, such that when the actuating member is in one position, it moves the link to hold the printing head and the platen roller apart, and the actuating member having a second position at which it moves the link to permit the movable one of the printing head and the platen roller to move to be pressed against the other.

2. Actuating means for a printing head of a printing machine, wherein the printing machine comprises a platen roller and comprises a printing head which is opposed to the platen roller, and the printing head and platen roller are adapted to be pressed against each other; and means for passing an information recording medium between the platen roller and the printing head for being imprinted upon by the printing head pressing against the platen roller;

a support for the platen roller and the printing head; the printing head being swingably supported on the support for movement toward the platen roller; the actuating means being for the printing head and comprising a set spring which is interlocked with the movable printing head and an actuating member to which the set spring is also connected; the actuating member supporting the set spring to pull the printing head toward the platen roller;

suppressing means comprising a link also connected with the printing head for preventing the printing head from moving toward the platen under the action of the set spring; the link being connected with the actuating member, such that when the actuating member is in one position, it moves the link to hold the printing head off the platen roller, and the actuating member having a second position at which it moves the link to permit the movable printing head to move toward the platen roller.

3. The actuating means of claim 2, wherein the actuating member comprises a pivotable lever pivoted to the support and connected with the suppressing means for pivoting to move the suppressing means; in the first position of the pivotable lever, the link being moved to hold the printing head off the platen roller and in the second position of the pivotable lever, the link being moved to permit the printing head to move toward the platen roller.

4. The actuating mechanism of claim 3, wherein the suppressing link extends between the pivotable lever, on the one hand, and the printing head, on the other hand; when the pivotable lever pivots to the first position thereof, it draws the link to move the printing head to the position away from the platen roller; when the pivotable lever pivots to the second position thereof, it permits the suppressing means link to move to permit the printing head to move toward the platen roller.

5. The actuating mechanism of claim 4, wherein the suppressing means link is of a length that when the actuating lever is in the second position thereof, the link permits the printing head to move toward the platen roller under the influence of the set spring to a position just before the printing head bangs against the platen roller, but sufficient for the printing head to contact the information medium over the platen roller, for avoiding damage to the platen roller by high impact between the printing head and the platen roller.

6. The actuating mechanism of claim 5, further comprising a stationary support member having two detent positions thereon and the actuating means pivotable lever being pivotable between the detent positions of the support member, with one of the detent positions of the support member being at the first position of the actuating means pivotable lever and the other detent position of the support member being at the second position of the actuating means pivotable lever; and manually operable means for moving the actuating lever between the two detented positions thereof on the support member.

7. Actuating means for a printing head of a printing machine, wherein the printing machine comprises a platen roller and comprises a printing head which is opposed to the platen roller, and the printing head and platen roller are adapted to be pressed against each other; and means for passing an information recording medium between the platen roller and the printing head for being imprinted upon the printing head pressing against the platen roller;

a support for the platen roller and the printing head; the printing head being swingably supported on the support for movement toward the platen roller; the actuating means being for the printing head and comprising a set spring which is interlocked with the movable printing head and an actuating member to which the set spring is also connected; the actuating member supporting the set spring to pull the printing head toward the platen roller;

suppressing means also connected with the printing head for preventing the printing head from moving toward the platen under the action of the set spring; the suppressing means being connected with the actuating member, such that when the actuating member is in one position, it moves the suppressing means to hold the printing head off the platen roller, and the actuating member having a second position at which it moves the suppressing means to permit the movable printing head to move toward the platen roller;

the actuating member comprising a pivotable lever pivotable to the support and connected with the suppressing means for pivoting to move the suppressing means; in the first position of the actuating means pivotable lever, the suppressing means being moved to hold the printing head off the platen roller and in the second position of the actuating means pivotable lever, the suppressing means being moved to permit the printing head to move toward the platen roller;

the suppressing means comprising a spring operating on the printing head in opposition to the force of the set spring; the suppressing means spring being connected, on the one hand, with the actuating means pivotable lever, in opposition to the connection of the set spring to the actuating lever and being connected to the printing head, on the other hand, in opposition to the connection of the set spring to the printing head.

* * * * *